US010364564B2

(12) United States Patent
Liu

(10) Patent No.: US 10,364,564 B2
(45) Date of Patent: Jul. 30, 2019

(54) SUPER DRAINAGE SYSTEM AND METHOD FOR FLOOD CONTROL

(71) Applicant: Xuejie Liu, Katy, TX (US)

(72) Inventor: Xuejie Liu, Katy, TX (US)

( * ) Notice: Subject to any disclaimer, the term of this patent is extended or adjusted under 35 U.S.C. 154(b) by 0 days.

(21) Appl. No.: 16/041,771

(22) Filed: Jul. 21, 2018

(65) Prior Publication Data

US 2019/0161954 A1 May 30, 2019

Related U.S. Application Data

(60) Provisional application No. 62/592,295, filed on Nov. 29, 2017.

(51) Int. Cl.

| | |
|---|---|
| ***E02B 3/04*** | (2006.01) |
| ***E03F 1/00*** | (2006.01) |
| ***E02B 11/00*** | (2006.01) |

(52) U.S. Cl.

CPC ..... *E03F 1/002* (2013.01); *E02B 3/04* (2013.01); *E02B 11/00* (2013.01)

(58) Field of Classification Search

CPC .. E02B 3/04; E02B 3/06; E02B 11/005; E03F 1/001

See application file for complete search history.

(56) References Cited

U.S. PATENT DOCUMENTS 4,457,646 A 7/1984 Laesch
4,661,014 A * 4/1987 Aubert ..... E02B 3/04 405/111
5,810,510 A * 9/1998 Urriola ..... E02B 11/005 137/236.1
6,012,872 A 1/2000 Humble
6,042,301 A 3/2000 Sovran
6,102,618 A 8/2000 Takada et al.
6,168,349 B1 1/2001 Perslow
6,491,473 B2 * 12/2002 Veazey ..... B63B 3/04 405/16
7,214,005 B1 5/2007 Davis
7,686,540 B2 * 3/2010 Urriola ..... E01C 11/225 405/43

(Continued)

FOREIGN PATENT DOCUMENTS

| | | |
|---|---|---|
| CN | 204703121 | * 10/2015 |
| CN | 204715287 | * 10/2015 |
| CN | 206308671 | * 7/2017 |

(Continued)

OTHER PUBLICATIONS

Kaushik, "SMART Tunnel in Kuala Lumpur: A Storm Water Tunnel with Built-in Motorway", published online at: https://www.amusingplanet.com/2013/05/smart-tunnel-in-kuala-lumpur-storm.html.

*Primary Examiner* — Frederick L Lagman

(57) ABSTRACT

A super drainage system and a method for flood control comprise an open channel, a reinforced concrete conduit (RCC) inside the open channel. The RCC has a bottom slab supported on a riverbed, a bank-side wall for retaining bank soils, and a top slab elevated above a predetermined level. The RCC supports a road below the top of river banks for traffic traveling along the river banks during normal weather conditions. The traffic is either on the top slab or on the bottom slab. During extreme weather conditions, traffic is evacuated from the super drainage system and the entire space is available for water conveyance.

20 Claims, 4 Drawing Sheets

(56) References Cited

U.S. PATENT DOCUMENTS

2018/0320356 A1* 11/2018 Wang ..... E03F 1/003

FOREIGN PATENT DOCUMENTS

| | | | | | |
|---|---|---|---|---|---|
| DE | 102010044607 | | * | 3/2012 | |
| EP | 2175071 | | * | 4/2010 | |
| GB | 190503311 | A | * | 10/1905 | ..... E02B 11/005 |
| KR | 2017005777 | | * | 1/2017 | |
| KR | 2017019206 | | * | 2/2017 | |
| WO | WO-2013172677 | A2 | * | 11/2013 | ..... E02B 11/005 |

* cited by examiner

SUPER DRAINAGE SYSTEM AND METHOD FOR FLOOD CONTROL

CROSS-REFERENCE TO RELATED APPLICATIONS

This application claims priority of U.S. Provisional Patent Application Ser. No. 62/592,295 filed on Nov. 29, 2017.

| U.S. Pat. Documents | | | |
|---|---|---|---|
| 4,457,646 | July 1984 | Laesch | 405/52 |
| 6,012,872 | January 2000 | Perry and Benet | 405/114 |
| 6,042,301 | March 2000 | Sovran | 405/112 |
| 6,102,618 | August 2000 | Takada et al | 405/52 |
| 6,168,349 | January 2001 | Perslow et al | 405/16 |
| 7,214,005 | May 2007 | Davis | 405/114 |

OTHER PUBLICATIONS

KAUSHIK, "SMART Tunnel in Kuala Lumpur: A Storm Water Tunnel with Built-in Motorway", published online at: https://www.amusingplanet.com/2013/05/smart-tunnel-in-kuala-lumpur-storm.html

STATEMENT REGARDING FEDERALLY SPONSORED RESEARCH OR DEVELOPMENT

Not Applicable

BACKGROUND OF THE INVENTION

1. Field of Invention

The present invention relates generally to draining massive water in flood control. Specifically, the present invention provides a reinforced concrete conduit (RCC) inside an open channel. The RCC retains earth banks and supports traffic traveling along the bank during normal weather conditions.

2. Description of the Related Art

In the prior art, storm water is typically drained to seas through open channels or enclosed channels. Open channels include creeks, channels, bayous, rivers, streams, etc. Enclosed channels include underground tunnels and pipes. Open channels are formed by two banks with a riverbed in between. Earth banks are likely to be eroded by fast-moving water and collapse. The eroded soils deposit in a waterway and block water flow. In order to prevent soil erosion at earth banks, retaining walls are often installed. Common retaining walls are made of bricks, stones, and reinforced concrete. In addition, concrete lining as disclosed in U.S. Pat. No. 6,168,349 or sheet piling made of steel or polymer is also used for erosion control.

Enclosed channels are typically made of reinforced concrete due to its high strength and long-lasting features. Reinforced concrete culverts are often used at street crossings where traffic is mostly perpendicular to the direction of water flow. They function like a bridge for traffic to cross a water way at a short distance (e.g., 100 m or less). When reinforced concrete conduits are used to drain water at longer distances, the water flows inside the conduits that are surrounded by soils (i.e., buried) as disclosed in U.S. Pat. No. 6,102,618 to Takada et al.

In order to reduce flood risk, a common method is to widen a water way if space is available. Another way to control flood is to increase the height of river banks using levees and/or continuous walls on the top of banks/levees. As an example, Humble and Benet disclosed an elevated water barrier made of rigid containers in U.S. Pat. No. 6,012,872. Sovran disclosed a rigid water barrier made of metal that is removable in U.S. Pat. No. 6,042,301. Davis disclosed a sectionalized flood control barrier to be placed on the top of a levee in U.S. Pat. No. 7,214,005, and water entered the box-type barrier serves as weight for stabilization. These methods increase the bank heights with temporary or permanent barriers in an attempt to contain a rising water in a water way.

Detention or retention facilities are also used to store water. These facilities include reservoirs, ponds, and underground spaces such as chambers as disclosed by Laesch in U.S. Pat. No. 4,457,646. These facilities are fluidly connected to a river through buried conduits. They store water at high water levels in the river and release water back to the river at low water levels in the river.

Drainage space has been used for other functions due to the fact that extreme weather conditions occur a few times per year and last several days or less. In order to fully utilize the space in a metropolitan area, a SMART (abbreviation for Storm-water Management and Road Tunnel) tunnel was built in Kuala Lumpur, Malaysia in 2007. This tunnel has three enclosed channels available for water drainage in case of flash flooding and top two channels for motorists during normal weather conditions. This design is great for debottlenecking. However, a giant tunnel is very costly and is not economically feasible for a lengthy drainage system over large areas. Another example to share the space is to use a flood plain beside a waterway for recreation such as sports/trails or parks. When flood water comes, this lower ground is under water and serves as a part of drainage and/or detention systems.

Due to soil erosion and sediment, existing drainage systems need maintenance. Removing sediment and other debris is likely to overwhelm city traffic in a conventional design. As a result, many storage and drainage facilities are left with reduced capacity. Building new drainage channels is often not an option for developed metropolitan areas due to space limitation.

There is a need to develop a super drainage system that not only handles massive water during extreme weather conditions, but also alleviate traffic jams during other weather conditions. This drainage system needs to be cost-effective, easy to maintain and long-lasting.

BRIEF SUMMARY OF THE INVENTION

The super drainage system in this invention includes a reinforced concrete conduit (RCC) inside an open channel. The RCC has a bottom slab supported on a riverbed, a first wall retaining a bank, a top slab elevated above a predetermined level and a second wall. Under normal weather conditions, the RCC supports a road under the top of the bank for traffic traveling along the bank. During an extreme weather condition, evacuate the traffic and make the entire space in the open channel and RCC available for water conveyance.

To increase the depth of an open channel, a downward wall extension can be added below a second wall. To avoid soil erosion to the bank above the top slab, an upward wall extension can be extended from the bank-side wall (i.e., first wall). In addition, a slab of RCC can be extended laterally to provide a wide surface or increase stability.

In one arrangement, the RCC receives sewage water from sewage pipes buried at its adjacent ground/bank and convey sewage water in normal conditions. In another arrangement, water inside the RCC is equalized with the water in the open channel.

In a preferred embodiment, rails are anchored to the top slab and used for passenger train services below the top of banks. During construction, installed rails can be used for transporting dirt and RCC segments. During operations, these train services avoid traffic interference with normal traffic on the street levels in metropolitan areas. With a railroad along a bank, any sediment or debris can be easily removed also.

Accordingly, it is a principal object of the invention to provide a drainage system with sufficient conveyance capacity.

It is another object of the invention to use the space of the super drainage system for traffic during normal weather conditions and alleviation of traffic jams in metropolitan areas.

It is another object of the invention to protect earth banks from erosion and collapse, and minimize maintenance.

It is another object of the invention to provide multiple channels side by side for separating dirty water from storm water and preserve fresh water resources.

It is another object of the invention to provide roads/trails, green spaces and clean water for leisure activities around an open channel in metropolitan areas.

BRIEF DESCRIPTION OF THE DRAWINGS

The super drainage system, method and advantages of the present invention will be better understood by referring to the drawings, in which.

DETAILED DESCRIPTION OF THE PREFERRED EMBODIMENT

Various terms are defined below. As used herein and in the claims, the term "super drainage system" means a drainage system that can handle massive amount of water without overflowing its banks during extreme weather conditions as well as offer a road and serve traffic during low water levels in normal weather conditions. The term "reinforced concrete conduit" is abbreviated to RCC. It means a box-shaped conduit having two walls and two slabs. It has a quadrilateral cross-section including trapezoid, rectangle or square. RCCs are made of concrete that is reinforced by steel wires or fibers. A RCC can be formed with a number of RCC segments. Each RCC segment has a preferred length of 1-5 m. The term "reinforced concrete conduit and extension" is abbreviated to RCCE. It means a reinforced concrete conduit with either wall extensions, slab extensions or both. An extension can be in alignment with a wall or slab, or at a certain angle from a wall or slab. The term "traffic" means the movement of vehicles or persons along a road that is not submerged in water. The traffic includes trains, automobiles, buses, bikers, pedestrians, etc. The trains include passenger trains (e.g., light rails, high-speed trains, and commuter trains) and freight trains that run on rails.

As used herein and in the claims, the term "a predetermined level" means a water level that is predetermined by a designer, operator or owner. When water in the drainage system reaches this predetermined level, evacuate all traffic from the system. This level is in general around the middle elevation of banks or lower, leaving sufficient space above for traffic during normal weather conditions. The term "normal weathers" means normal precipitations. During these events, the water remains below the predetermined level. It normally accounts for the majority time of a year (e.g., 350 days). The term "extreme weathers" means a heavy rain that lasts for more than several hours, or rains last for days, or excessive water from melting snow due to unexpected warm temperatures. They cause water in the drainage system to rise above the predetermined level. It is an event with low probability of occurrence (e.g., a few times per year or less). The term "entire space" means all cavities confined by two banks, including any enclosed channel and open channel in the super drainage system as well as the space below the top of an extended bank across a flood plain when exists. The term "sleepers" means crossties, beams with a rectangular cross-section being laid underneath rails. They tie two rails in place and form a railroad track. They transfer loads from rails to the two walls of RCC.

Figure 1:
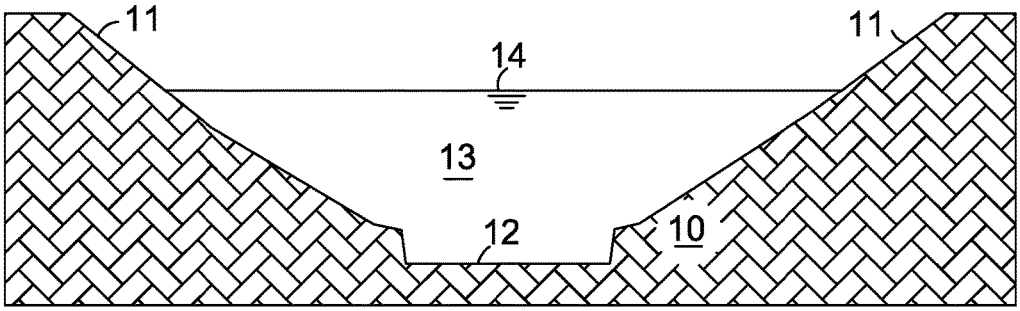
FIG.1 (Prior Art)
FIG. 1 is an open channel with two banks and a riverbed in prior art.

FIG. 1 is an illustration of prior art. An open channel 13 is confined by two river banks 11 and a riverbed 12 with a water level 14. Banks 11 are earth banks and formed with bank soils 10. Water flows from high elevation to low elevation by gravity along an open channel. These banks typically have a gentle slope (e.g., 30 degree or less) and are subjected to erosion.

Figure 2:
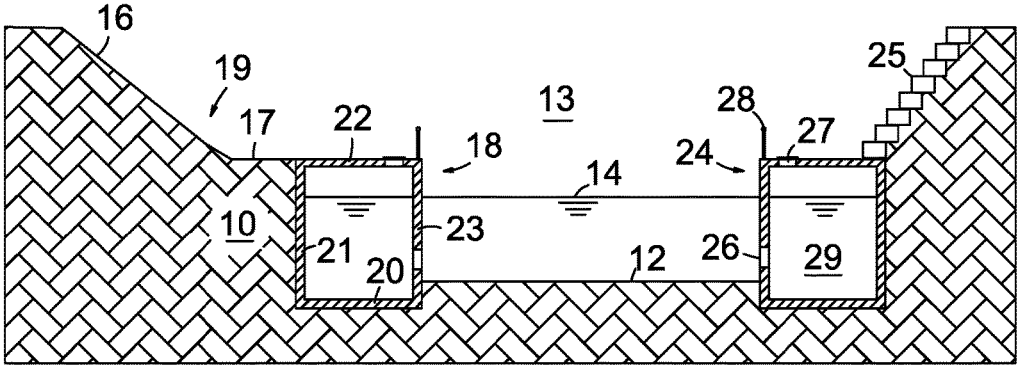
FIG. 2 is a first embodiment of the invention with RCCs retaining both banks.

FIG. 2 is a first embodiment of this invention upgraded from an open channel in FIG. 1. A first bank 19 consists of an earth slope 16 around the top, an earth bench 17 at a middle elevation and a first RCC 18 around the bottom. The first RCC 18 has a bottom slab 20 supported on a deeper portion of a riverbed 12, a first wall 21 (i.e., bank-side wall) retaining bank soils 10, a top slab 22 located around a middle elevation of the first bank 19, and a second wall 23 in contact with water in an open channel 13. The top slab 22 is preferably set at 2-8 m below the top of banks so that enough space is available for traffic passing a street bridge underneath. For example, a minimum of 5 m of clearance is needed between a street bridge (not shown) and the top slab 22 for trains. At locations without a bridge or with a bridge elevated above river banks, the traffic on the top slab 22 can be extended upward above the top of the banks. The top slab 22 serves as a road for traffic during most weather conditions.

As a variation, a second bank (on the right) is retained by a second RCC 24 at low elevations and blocks 25 at high elevations. Side openings 26 in a water side wall are at a lower elevation for equalizing the water level 14 in the open channel 13 and in enclosed channel 29. Top openings 27 in the top slab allow air to enter or exit the enclosed channel 29 freely when the water level 14 varies. Fences 28 prevent people from falling into the water. At the riverbed 12, erosion control measures such as rip-rap or concrete matrix can be implemented. During extreme weather conditions, the storm water will flow through both the enclosed channels and open channel 13. In comparison with a natural channel in FIG. 1 in prior art, the super drainage system in FIG. 2 increases the water conveyance capacity without increase in the width and depth of the open channel.

Alternatively, the second bank can be the same as the first bank 19. Alternatively, an open channel can have a first bank 19 and an earth bank 11 shown in FIG. 1. The earth bank has common erosion control measures such as grass/plant, concrete matrix, concrete lining, blocks 25, retaining walls (e.g., 56 in FIG. 5), etc. Alternatively, an open channel can have any one of the banks shown in FIG. 2 through FIG. 6.

Figure 3:
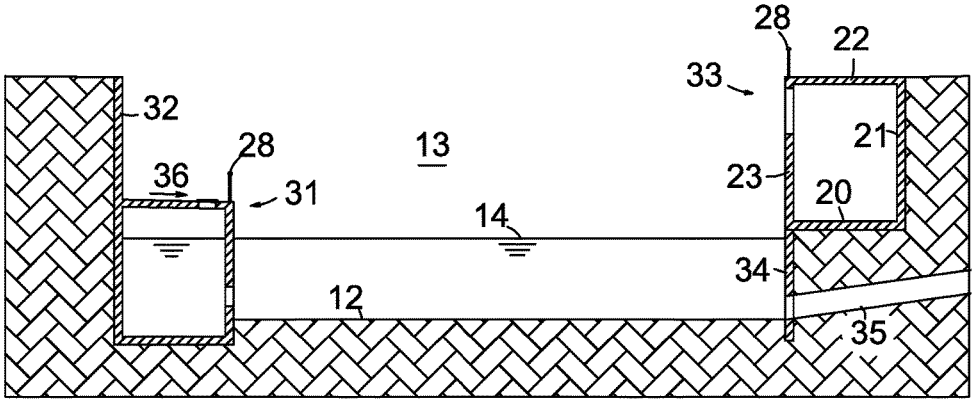
FIG. 3 is a second embodiment of the invention with RCCEs retaining both banks.

FIG. 3 shows a second embodiment of this invention, in which each RCC has a vertical wall extension. A first RCCE 31 has an upward wall extension 32 that extends all the way to the top of a first bank (left). As a variation, a second bank (on the right side) is retained by a second RCCE 33 with a downward wall extension 34. The top slab 22 of the second RCCE 33 is at a ground or street level, and allows for normal surface traffic if needed. Underneath a bottom slab 20, a sewage pipe 35 is fluidly connected to an open channel 13 for receiving water from a local storm sewage system. In this figure, a predetermined level is set at a water level 14, which is about 0.3 meter below the bottom slab 20 of the second RCCE 33. The top slab of the first RCCE 31 has a small slope 36 (e.g., 2%) towards the open channel for draining any surface water to the open channel.

In this embodiment, both the upward and downward wall extensions retain banks along with the first walls. This creates more space for water conveyance. Along the first bank, traffic travels on the top slab of the first RCCE 31. Along the second bank, traffic travels on the bottom slab 20 of the second RCCE 33 inside the enclosed channel. In either case, RCCEs support a road for traffic and the road is preferably 2-8 meters below the top of the banks. This figure shows a monolithic RCCE that is preferably pre-casted. Alternatively, the downward wall extension 34 is casted separated from reinforced concrete conduit (RCC). The downward wall extension 34 is installed first and RCC is then laid on top of the wall extension along with an interlock mechanism (e.g., pins and holes, not shown) between these two.

Figure 4:
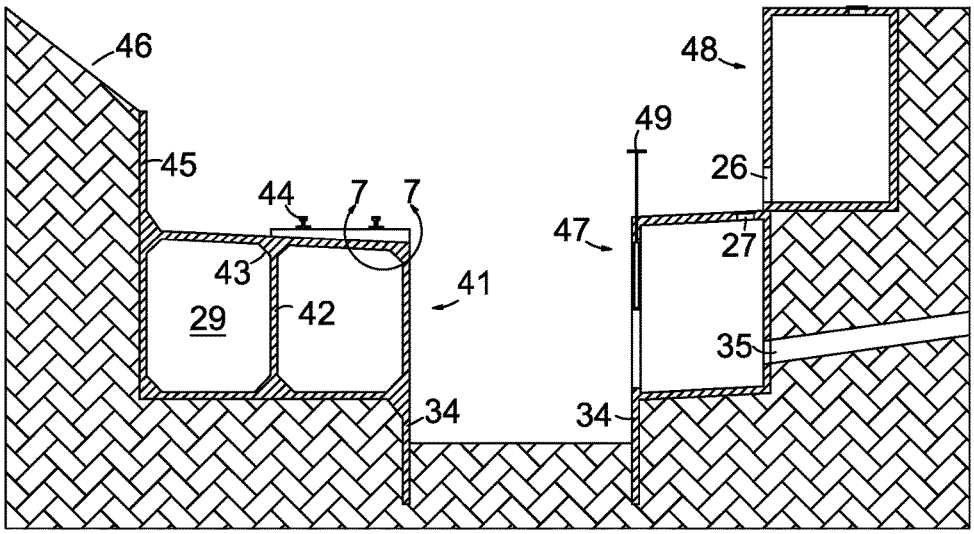
FIG. 4 is a third embodiment of the super drainage system with a deep riverbed.

FIG. 4 shows a third embodiment of this invention with a deep riverbed, in which water conveyance is increased by deepening a river/bayou. A first bank is retained by a RCCE 41 with a grassy earth slope 46 around its top. The RCCE 41 has both a downward wall extension 34 and an upward wall extension 45. The RCCE 41 has a partition wall 42 inside and haunches 43 at the corners of concrete. These haunches 43 are standardized design of reinforced concrete box culverts and can be added to the RCCs in other figures. Rails 44 are anchored to a top slab.

The enclosed channel 29 is sealed along its perimeter in this case. With both ends open, the RCC conveys water from its starting point upstream to its end point downstream (not shown), similar to a typical buried RCC in prior art. It can be used for conveying fast-moving water under pressure with means such as pumps. In another word, conveyance capacity can also be increased by speeding up flow inside an enclosed channel (i.e., RCC) if deepening or widening an open channel is restricted. Alternatively, four rails (i.e., two tracks) can be installed on the top slab of RCCE 41. Any previously installed rails can be used to transport materials during construction. Alternatively, the two rail tracks are installed inside the enclosed channel 29, separated by the partition wall 42. Alternatively, the partition wall 42 is replaced by columns at an interval of 1-3 meters.

As a variation, the second bank is retained by a bottom RCCE 47 and a top RCC 48. Pins can be used for locking the water-side wall of the top RCC 48 and the bank-side wall of the bottom RCCE 47 together. A sewage pipe 35 is fluidly connected with the bottom RCCE 47. The top RCC 48 can support surface traffic on its top slab and a subway on its bottom slab. Two-way gates 49 are installed in the water-side wall of the bottom RCCE 47 for flow control.

Figure 5:
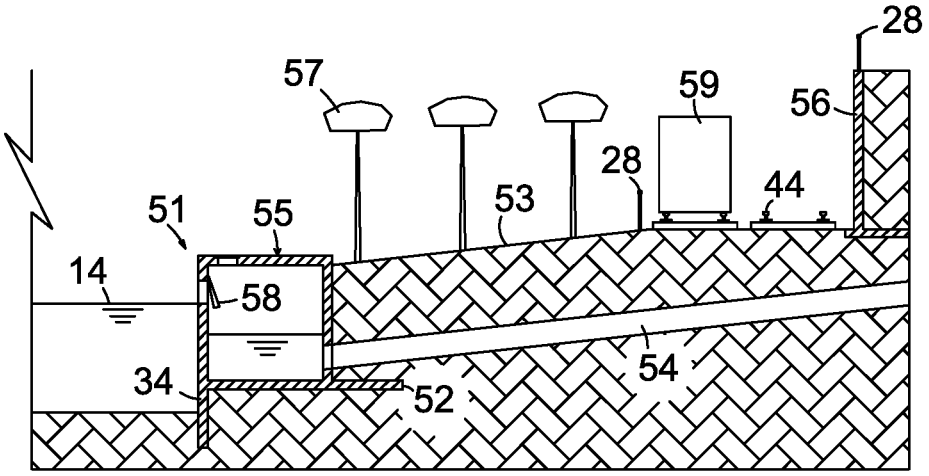
FIG. 5 is a fourth embodiment of the super drainage system in a spacious area.

FIG. 5 shows a fourth embodiment of this invention in a spacious area. To save page space, only a half the system is shown. A bank has its formal portion retained by a RCCE 51 and extended portion retained by a retaining wall 56 that are separated by a flood plain 53. The RCCE 51 has a downward wall extension 34 and a horizontal slab extension 52 from its bottom slab for integration with bank soils. On the spacious flood plain 53, there are fences 28, rails 44 and trees 57. A sanitary sewage pipe 54 is fluidly connected to the enclosed channel of the RCCE 51. One-way gate 58 is in the second wall below the top slab. It is preferred that sanitary sewage water flows in the enclosed channel while rain water flows in the open channel. When the rain water in the open channel reaches the gate level, it pushes the one-way gate 58 open and excess rain water will enter the enclosed channel.

During normal weathers, people (not shown) walk on a road 55 supported by the RCCE 51 and commuter trains 59 run near the retaining wall 56. Optionally, the flood plain 53 can also be used for leisure activities. When an extreme weather condition is predicted and the water rises to a predetermined level, evacuate trains 59 and people from the super drainage system, and make the entire space available for water conveyance. In this case, the flood plain 53 is similar to a wide bench 17 in FIG. 2 and the space above the flood plain 53 starts to convey water as the water level rises above the RCCE 51.

Figure 6:
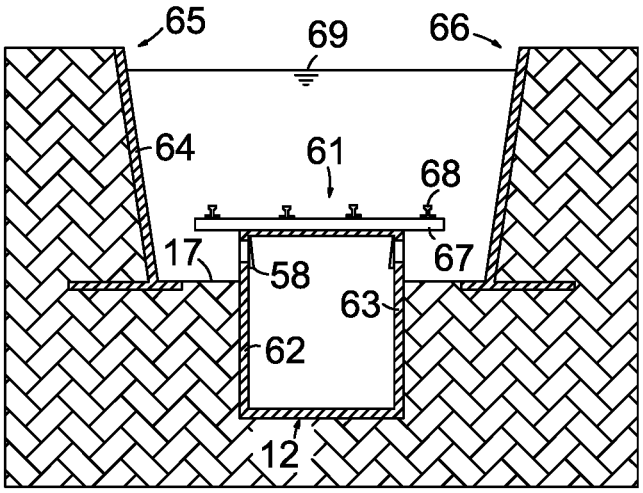
FIG. 6 is a fifth embodiment of the super drainage system in a limited space.

As shown in FIG. 2, the distance between a first RCC 18 and second RCC 24 can be adjusted according to a design conveyance capacity. For example, increasing the distance (i.e., widening) can increase the design capacity. On the contrary, merging a first RCC 18 and second RCC 24 as one reaches the narrowest possible width. FIG. 6 shows a fifth embodiment of the invention that comprises one enclosed channel passing through a limited space.

As shown in FIG. 6, a RCC 61 is located in an open channel and has its bottom slab supported on a riverbed 12. A first wall 62 retains the lower portion (i.e., below a bench 17) of a first bank 65 while a retaining wall 64 retains the upper portion of the first bank (i.e., above a bench 17). A second wall 63 retains the lower portion of a second bank 66. One-way gates 58 are set in both walls of the RCC 61 above the bench 17 for receiving water from the open channel. At normal weathers, water flows mainly in the enclosed channel. Alternatively, there are openings or entrances in the top slab.

Sleepers 67 are embedded in the top slab of the RCC 61. Four rails 68 are anchored to the sleepers 67. Alternatively, two rails (i.e., one track) are installed on the top slab of the RCC 61, which results in a minimum width of an open channel (e.g., 5 meters). Two rails are anchored to the bottom slab of the RCC 61 as a slab track. Alternatively, motorists, bikers or people use the top slab of the RCC 61 as a road. In this figure, water reaches a maximum water level 69 during extreme weather conditions.

As shown in FIG. 2 through FIG. 6, the super drainage system comprises a RCC (i.e., enclosed channel) inside an open channel. The RCC comprises communication elements for fluid communication between the RCC and open channel. These communication elements include openings 26 in the walls or slabs of RCC, two-way gates 49 in the second wall, and one-way gates 58 in the second wall. They regulate water levels in the super drainage system and ensure that the road supported by the RCC is not submerged in water and the vacant drainage space above the road is safely used for traffic during normal weather conditions. As a result, the super drainage system is configured for controlling flood during extreme weather conditions and offering a road for traffic during normal weather conditions.

Figure 7:
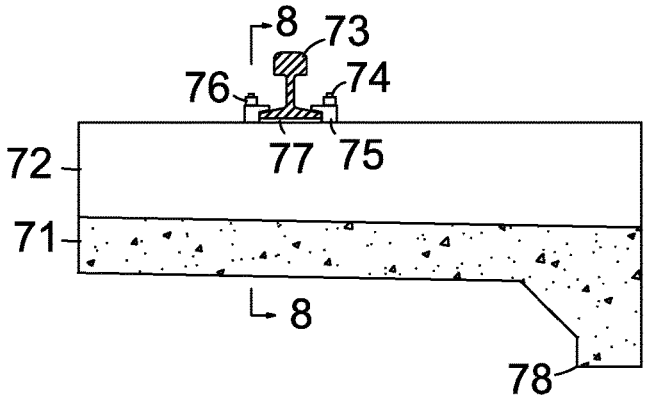
FIG. 7 is the detailed view of the top slab along 7-7 line in FIG. 4.

FIG. 7 shows details of rail anchorage along line 7-7 in FIG. 4. A rail 73 is anchored to sleepers 72 with embedded studs 74, clips 75, and nuts 76. There is a rubber pad 77 between rail 73 and sleepers 72 for noise reduction and flexibility. Sleepers 72 are embedded in a top slab 71. The top slab 71 is casted together with a second wall 78.

Figure 8:
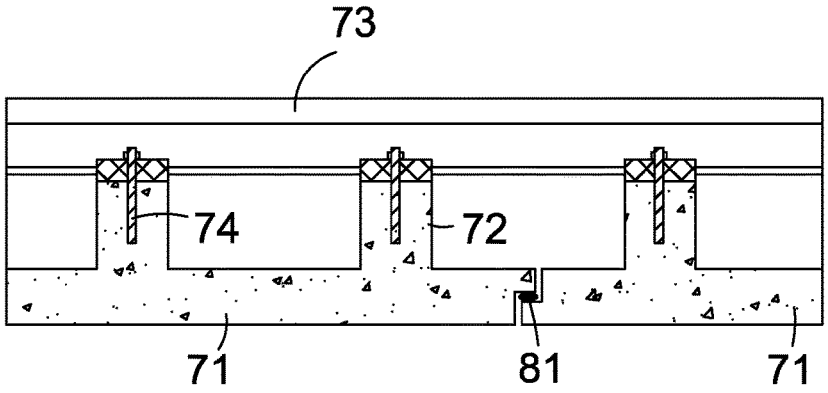
FIG. 8 is the cross-section along 8-8 line in FIG. 7.

FIG. 8 shows a cross-section view along line 8-8 in FIG. 7. Two top slabs 71 are joined together and sealed with a rubber gasket ring 81 at male-female ends of two adjacent RCC segments. Studs 74 are embedded in sleepers 72. Alternatively, dowels with inner threads can be embedded in the top slab, and screw spikes are used to anchor the rail to the top slab. Alternatively, top slabs 71 are hollow core slabs. Alternatively, top slabs 71 are T slabs laid upside down. Alternatively, top slabs 71 are solid slabs.

Buried reinforced concrete box culverts are widely for drainage. Commonly used seals at joints include elastomer tubes/stripes, rubber gasket rings, etc. They are readily available from the market and not shown here for simplicity. It is preferred that the RCCs or RCCEs are pre-casted in segments, each having a length of 2-3 meters with a male end and a female end. A RCC is formed by inserting the male end of a RCC segment into the female end of an adjacent RCC segment and extends along a bank of an open channel continuously.

Figure 9:
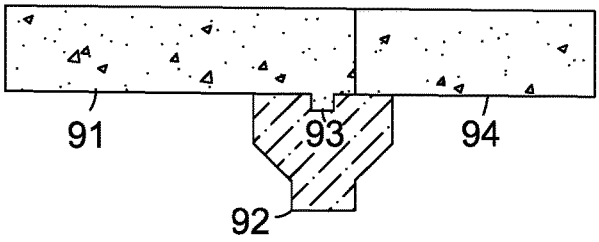
FIG. 9 is a variation to the top slab shown in FIG. 8.

FIG. 9 is a variation of details in FIG. 7. As opposite to a monolithic structure in FIG. 2 through FIG. 7, each RCC segment can be pre-casted in two parts for easy transportation and handling. For example, a RCC segment is divided into a U and a top slab 91. With a grove at the top of a second wall 92 and a key 93 at the bottom of top slab 91 and grout, top slab 91 can be quickly installed onto the U onsite. A slab extension 94 extends from the top slab 91 and is casted in one piece with the top slab 91.

Alternatively, metal pins can be used for locking a top slab onto both walls of the U through pre-made holes. Alternatively, dowels can be pre-embedded in a top slab and inserted into pre-made holes on the top of U. It is preferably that the top slab 71 and sleepers 72 are pre-casted as one piece. Alternatively, sleepers are pre-casted separately and anchored to a top slab during construction. These sleepers transfer traffic loads onto a first wall 62 and a second wall 63 as denoted in FIG. 6.

A method for establishing a drainage system that is configured for controlling flood during extreme precipitations and offering a road for traffic during normal weather conditions includes inserting a male end of a RCC segment into a female end of an adjacent RCC segment repeatedly and forming a reinforced concrete conduit (RCC) in an open channel. The RCC has a bottom slab supported on a riverbed, a bank-side wall retaining bank soils, and a top slab elevated above a predetermined level. The RCC supports the road that serves traffic traveling along a bank during normal weather conditions.

A method for alleviating traffic congestion in a metropolitan area comprises serving traffic on a road inside the drainage system during normal weather conditions. The road is 2-8 meters below the bank top on the top slab or bottom slab of the RCC. Passenger trains are preferred as they are environmentally friendly. During extreme weather conditions, traffic is evacuated from the system. Both the enclosed channel inside the RCC and the open channel are available for conveyance of massive water.

I claim:

1. A drainage system configured for controlling flood during extreme weather and comprising a road for traffic during normal weather, said system comprising:

a) an open channel having a first bank, a second bank and a riverbed;

b) a reinforced concrete conduit (RCC), said RCC has a bottom slab supported on said riverbed, a first wall for retaining said first bank, a top slab elevated above a predetermined level and a second wall and said RCC further comprising a number of RCC segments, each of said RCC segments having a male end and a number of RCC segments, each of said RCC segments having a male end and a female end;

c) an opening in said RCC for water communication with said open channel; and wherein said RCC supports said road below the top of said first bank, and said traffic travels on said road along said first bank during normal weather.

2. The drainage system of claim 1, wherein said traffic is evacuated when water in said open channel reaches said predetermined level, and an entire space of said open channel and said RCC is available for water conveyance.

3. The drainage system of claim 1, wherein said RCC further comprising a wall extension that extends from one of said first wall and second wall.

4. The drainage system of claim 1, wherein said RCC further comprising a slab extension that extends from one of said top slab and bottom slab.

5. The drainage system of claim 1, wherein said road is on said top slab, said top slab is 2-8 meters below the top of said first bank.

6. The drainage system of claim 1, wherein said road is on said bottom slab inside said RCC, said bottom slab is 2-8 meters below the top of said first bank.

7. The drainage system of claim 1 further comprising rails, said rails are anchored to one of said top slab and bottom slab and form a railroad track.

8. The drainage system of claim 7 further comprising sleepers, said sleepers are embedded in said top slab.

9. The drainage system of claim 1, wherein said opening further comprises a two-way gate or an one-way gate in said second wall.

10. The drainage system of claim 1 further comprising a buried sewage pipe, said sewage pipe is fluidly connected to said RCC.

11. The drainage system of claim 1, wherein said first bank further comprising a bench at a middle elevation between the top of said first bank and said riverbed.

12. The drainage system of claim 1, wherein said first bank further comprising an earth slope above said top slab.

13. The drainage system of claim 1, wherein said first bank further comprising a retaining wall for retaining said first bank above said top slab.

14. The drainage system of claim 1, wherein said second wall retains said second bank.

15. A method for alleviating traffic congestion in a metropolitan area comprising serving traffic on a road inside a drainage system during normal weather, said drainage system comprising: an open channel having a first bank, a second bank and a riverbed, a reinforced concrete conduit (RCC) inside said open channel, said RCC further comprising a number of RCC segments, each having a male end and a female end;

wherein said road is 2-8 m below the top of said first bank and supported by said RCC along said first bank, and said RCC has a bottom slab supported on said riverbed, a first wall retaining said first bank, a top slab elevated above a predetermined level, a second wall and an opening in said RCC for water communication with said open channel.

16. The method of claim 15 further comprising evacuating said traffic from said drainage system for flood control during extreme weather.

17. The method of claim 15, wherein said road further comprising rails, said rails are anchored to one of said top slab and said bottom slab and form a railroad track.

18. A method for establishing a drainage system configured for controlling flood during extreme weather and offering a road for traffic during normal weather, said method comprising:

a) inserting a male end of a reinforced concrete conduit (RCC) segment into a female end of an adjacent RCC segment repeatedly and forming an RCC with a number of RCC segments inside an open channel, said RCC has a bottom slab supported on a riverbed of said open channel, a first wall retaining a first bank of said open channel, a top slab elevated above a predetermined level, a second wall and an opening in said RCC for water communication with said open channel; and wherein said RCC supports said road below the top of said first bank, said traffic travels on said road along said first bank during normal weather.

19. The method of claim 18, wherein said RCC segments are pre-casted.

20. The method of claim 18 further comprising anchoring rails to said top slab for forming a railroad track.

* * * * *